United States Patent [19]

Kessel

[11] 4,092,747

[45] June 6, 1978

[54] ODOR TRAP FOR DRAIN

[76] Inventor: Bernhard Kessel, Ingolstadter Str. 20, 8073 Kosching, Germany

[21] Appl. No.: 688,309

[22] Filed: May 20, 1976

[30] Foreign Application Priority Data

May 21, 1975 Germany ..... 2522425

[51] Int. Cl.[2] ..... E03C 1/282

[52] U.S. Cl. ..... 4/286; 137/247.41

[58] Field of Search ..... 137/247.11, 247.13, 137/247.15, 247.17, 247.19, 247.21, 247.23, 247.25, 247.27, 247.29, 247.31, 247.33, 247.35, 247.37, 247.39, 247.41, 247.43, 247.45, 247.47, 247.49, 247.51; 4/69, 207, 286; 285/179

[56] References Cited

U.S. PATENT DOCUMENTS

| | | | |
|---|---|---|---|
| 505,302 | 9/1893 | Stander | 137/247.11 |
| 741,919 | 10/1903 | Madden | 4/69 |
| 841,118 | 1/1907 | Byrne | 137/247.31 |
| 1,456,105 | 5/1923 | Heinkel | 137/247.11 |

FOREIGN PATENT DOCUMENTS

| | | | |
|---|---|---|---|
| 76,164 | 1/1946 | Norway | 137/247.15 |
| 56,987 | 8/1911 | Switzerland | 137/247.15 |

*Primary Examiner*—Richard E. Aegerter
*Assistant Examiner*—John W. Shepperd
*Attorney, Agent, or Firm*—Karl F. Ross

[57] ABSTRACT

A trap for a drain has a housing with a sidewall forming a lateral exit port above its bottom. A tubular insert fitted to that sidewall forms a conduit with a bottom inlet beneath the level of the exit port and a side outlet registering with this port. The outlet is framed, along about a lower third of its periphery, by a generally spoon- or trough-shaped tongue extending inwardly therefrom while rising toward but terminating short of the horizontal midplane of the outlet; a ring-segmental clearance remaining between this tongue and the peripheral conduit wall has a cross-sectional area equal to or slightly larger than that of the outlet.

9 Claims, 6 Drawing Figures

ODOR TRAP FOR DRAIN

CROSS-REFERENCE TO RELATED APPLICATIONS

This application is related to my concurrently filed applications Ser. Nos. 688,282 and 688,283.

FIELD OF THE INVENTION

My present invention relates to an odor trap for a drain designed to conduct waste water from a sump, gully or the like to a sewer.

BACKGROUND OF THE INVENTION

In such a trap, especially one installed in a basement or some other part of a dwelling, it is necessary to block the escape of sewer gases by allowing a pool of water to accumulate on the bottom of the trap beneath an outlet which the runoff can reach only by way of that pool. Certain regulations have been established regarding the effective height of the pool, i.e. the distance between its level and a submerged inlet of a conduit leading upwardly to the trap exit. Thus, as a rule of thumb, that effective height should be not less than the diameter of the exit port. In practice, this height may be 100 mm or more. It is also important to make the flow path through the conduit so wide as to prevent any congestion from developing within the trap when the water enters at a high rate almost equaling the capacity of the drain pipe which carries it off to the sewer. This means that the cross-sectional area of the path should at no place be less than that of the outlet.

In order to facilitate the cleaning of a trap that has become filed with sludge, it has already been proposed (see, for example, German utility model No. 1,958,096) to provide a generally elbow-shaped conduit whose outlet end can be removably fitted into the exit port of the trap and which is internally provided with an upstanding weir allowing the water to accumulate within that conduit to a level higher than the bottom edge of the outlet opening. The flow path left free above the weir, however, is relatively narrow and is susceptible to clogging by muddy water. The insertion of such a fitting into an exit port is not always convenient; it can also happen that the fitting sticks to the port and can be extracted only with difficulty. Problems arise, furthermore, in attempting to insure a fluidtight seal between the fitting and the tubing that forms the port, especially after repeated removals and reinsertions. Without a close fit, however, the escape of sewer gases into the trap and thence into the atmosphere cannot be effectively prevented.

OBJECT OF THE INVENTION

The object of my present invention, therefore, is to provide an improved odor trap of this type which is of compact construction and obviates the aforestated drawbacks.

SUMMARY OF THE INVENTION

An odor trap according to my invention comprises a tubular insert adjacent a sidewall of an upwardly open housing, this insert having a lateral outlet registering with an exit port of the sidewall. Waste water enters the insert through an inlet at the bottom of its peripheral wall and rises toward the horizontal midplane of the outlet within a generally ring-segmental clearance formed between the peripheral wall and an upwardly concave tongue which extends inwardly from the lower periphery of the outlet opening and terminates somewhat below the aforementioned midplane. The cross-sectional area of the ring-segmental clearance, constituting the flow path from the inlet to the outlet, ought to be at least equal to that of the outlet.

If the outlet is circular, as will usually be the case, the generally spoon- or trough-shaped tongue may have a curved bottom hugging the outlet over substantially the lower third of its periphery, that bottom lying between a pair of upstanding flanks and rising together with these flanks to a level below the horizontal midplane of the outlet. The tongue bottom, upon reaching that level, forms an edge remote from the outlet opening which is curved about a vertical axis disposed inwardly of that opening.

Advantageously, the peripheral wall of the tubular insert is a generally cylindrical conduit which is flattened on the side of the outlet and is curved about the same vertical axis as the upper edge of the tongue bottom, at least from the aforementioned midplane down. the peripheral conduit wall, whose radius of curvature below that midplane should substantially exceed the radius of the outlet, merges above the midplane along a bend opposite the outlet into a part-cylindrical upper surface of substantially the same radius as the outlet and coaxial therewith.

BRIEF DESCRIPTION OF THE DRAWING

The above the other features of my invention will now be described in detail with reference to the accompanying drawing in which.

SPECIFIC DESCRIPTION

Figure 1:
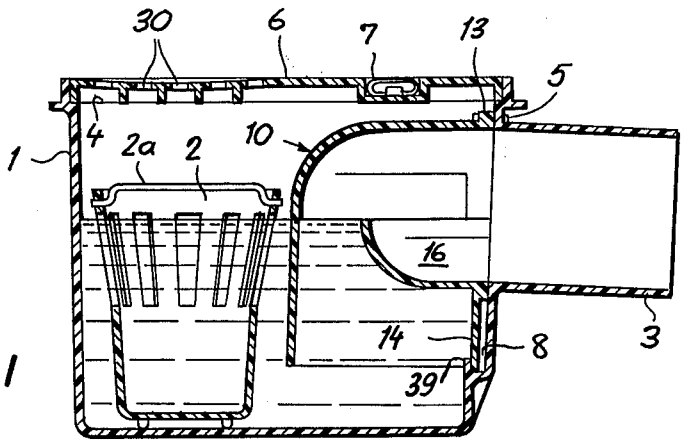
FIG. 1 is a longitudinal sectional view of an odor trap embodying my invention.
Figure 2:
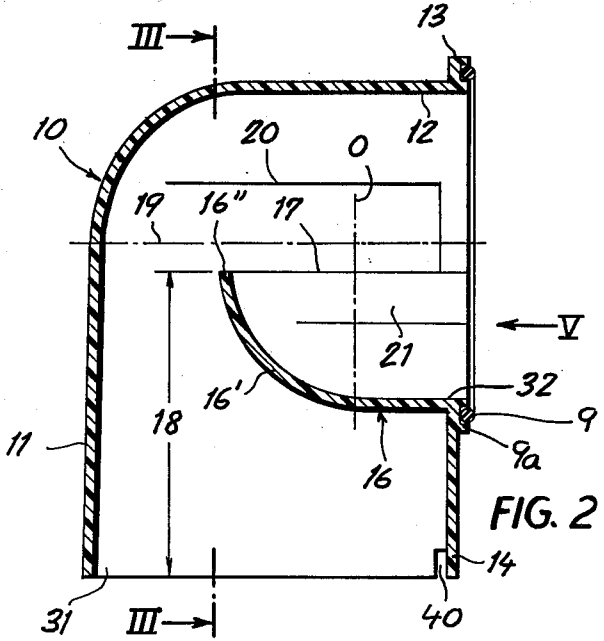
FIG. 2 is a similar view, taken on the line II—II of FIG. 3 and drawn to a larger scale, of an insert forming part of the trap of FIG. 1.
Figure 6:
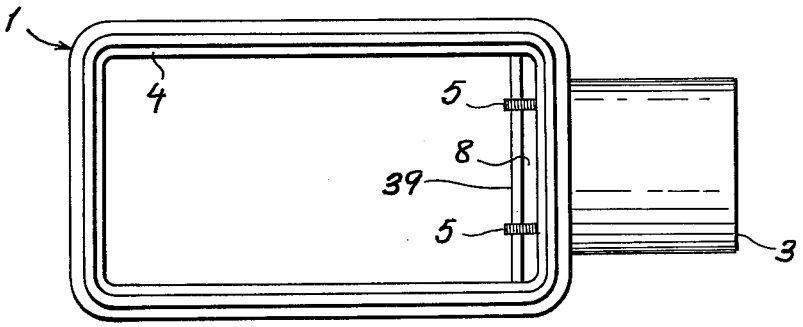
FIG. 6 is a top view of the housing of the trap shown in FIG. 1.

As illustrated in FIGS. 1 and 6, a trap according to my invention comprises a housing 1 of rectangular outline whose open top forms a peripheral rabbet 4 for the seating of a removable lid 6. The left-hand half of the lid is provided with a multiplicity of perforations 30 through which rainwater or other liquid wastes may enter the housing 1. The right-hand half of the lid has a countersunk grip 7 to facilitate its removal from the housing. A filter screen in the form of a removable basket 2, with handle **2*a*, is disposed below the perforated half of the lid in order to catch solid objects such as pebbles dropping through the lid into the housing. A nipple 3 forms an exit port in the upper part of the right-hand sidewall of housing 1** and is tilted slightly downwardly for connection to a nonillustrated sewer pipe.

Figure 3:
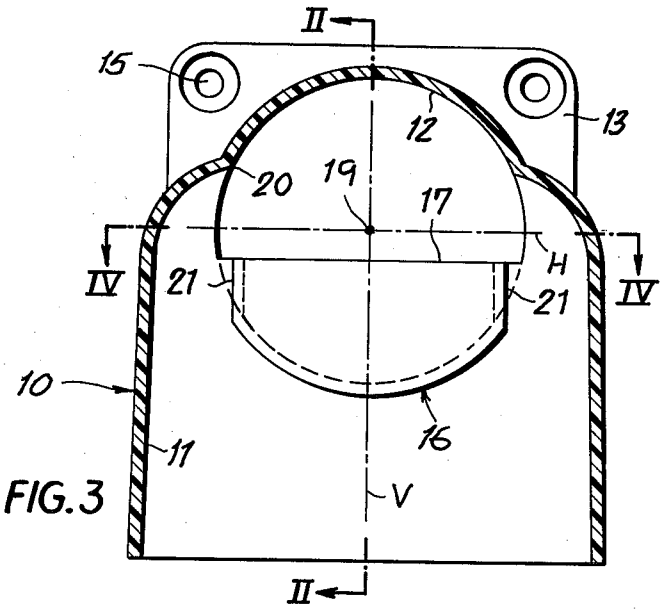
FIG. 3 is a cross-sectional view taken on the line III—III of FIG. 2.

A tubular insert 10 is molded or deep-drawn from a tough and corrosion-resistant plastic material, such as polyester, from which the housing 1 and its lid 6 may also be formed in like manner. Insert 10 is removably seated in the housing 1 adjacent its right-hand sidewall provided with the exit port 3. This insert, more fully illustrated in FIGS. 2–5, comprises essentially a downwardly open conduit 11 forming a depending skirt around a bottom inlet 31; an outlet 32 on the side of the conduit registers with exit port 3 and is centered on a horizontal axis 19. A generally spoon-shaped tongue 16 is integral with conduit 11 and has a rising bottom 16' which is upwardly concave in the vicinity of outlet 32 and hugs that outlet along the lower part of its periphery, specifically over an arc of about 120° as seen in FIG. 3. Beyond that arc the tongue 16 has a pair of upstanding flanks 21 which rise to a level 17 slightly below the horizontal midplane H of the outlet including its axis 19. In the illustrated embodiment, the tongue 16 extends inwardly from outlet 32 for about two thirds of the width of conduit 11 in a vertical plane of symmetry V bisecting the outlet; the bottom 16' of tongue 16 extends inwardly from the outlet along an approximately straight line to a vertical axis 0 and then curves upwardly with a radius close to that of the outlet opening, terminating at level 17 in a nearly semicircular edge 16'' which is centered on axis 0 (see FIG. 4) and merges almost tangentially into the flanks 21. The radius of curvature *r* of edge 16'' is about half the radius R of the peripheral wall of conduit 11 which is also curved about axis 0 in its cylindrical part, i.e. from midplane H down. Thus, the distance of axis 0 from the flattened side of the conduit, formed with the outlet 32, is roughly equal to radius *r* which in turn is only slightly less than the radius of the outlet opening.

Figure 5:
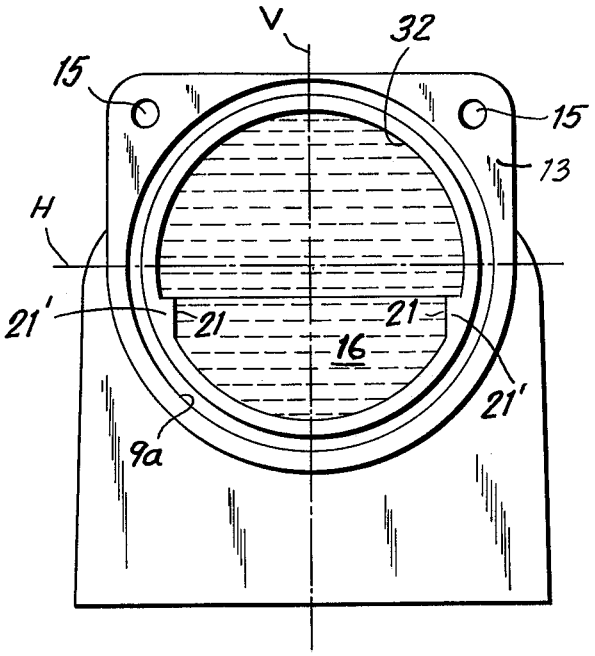
FIG. 5 is a face view of the insert taken in the direction of arrow V in FIG. 2.

As best seen in FIGS. 3 and 5, the flat side of conduit 11 is formed with a vertical flange 13 which surrounds the outlet 32 and has a circular groove 9*a* of rectangular cross-section accommodating an elastic sealing ring 9 bearing upon the adjoining housing wall in the assembly of FIG. 1. That housing wall is formed with an upwardly open pocket 8 bounded by a lip 39 which enters a pair of corresponding notches 40 (one shown in FIG. 2) in the bottom edge of conduit 11 to insure a proper seating of insert 10 in the housing. A flat foot 14, separated by the notches 40 from the bottom zone of the cylindrically curved conduit portion, enters the pocket 8 from above. The mounting of insert 10 is completed with the aid of bolts 5 (FIGS. 1 and 6) projecting inwardly from the right-hand housing wall and passing through lateral holes 15 of flange 13; the bolts 5 are firmly embedded in the housing wall and are long enough to be engaged by nuts holding the flange 13 in position.

Figure 4:
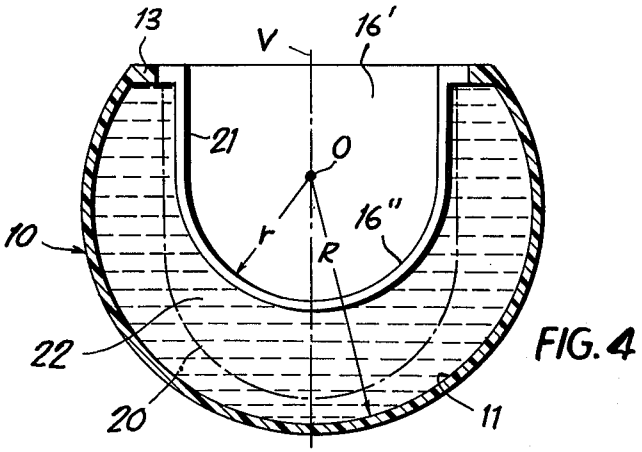
FIG. 4 is a cross-sectional view taken on the line IV—IV of FIG. 3.

Tongue edge 16'' forms the inner boundary of a generally ring-segmental clearance 22 which is externally bounded by the peripheral wall of conduit 11 and whose cross-sectional area, shaded in FIG. 4, is at least equal to the similarly shaded cross-sectional area of the flow path of outlet 32 (FIG. 5).

The peripheral wall of conduit 11 merges smoothly, in the region of midplane H, into a cowl-shaped top above that midplane, this top converging laterally toward the plane of symmetry V up to a U-shaped curve 20 whose projection upon the plane H has been indicated in phantom lines in FIG. 4. Curve 20 represents the intersection of a generally spheroidal wall portion with a part-cylindrical roof 12 which is centered on axis 19 and has the same radius as outlet 32 so as to hug that outlet along the upper part of its periphery, over an arc here shown to exceed that of tongue bottom 16'. The roof 12 is thus bounded by two substantially horizontal edges, i.e. the straight legs of curve 20, which are spaced from the plane H by a distance preferably ranging between 10% and 25% of the diameter of the outlet opening; that distance, accordingly, should not be greater than approximately half the outlet radius so that the arc spanned by the roof 12 is at least a quadrant.

If the insert 10 should become clogged, it can be quickly and easily removed from the housing 1 after an unscrewing of the nuts from the bolts 5 whereupon the contents of the housing will be rapidly discharged into exit port 3. Thanks to the absence of sharp internal corners and recesses, this insert can be readily cleaned after its extraction from the housing. The distance 18 (FIG. 2) between the tongue edge 16' and the inlet 31 determines the height of the water pool continuously present in the insert during normal operation. With the water level 17 thus established close to the midplane H of the outlet 32, the requirement of making that height at least equal to the diameter of the outlet opening can be readily satisfied even with a relatively shallow housing. This is particularly advantageous in the case of a simple drain for rainwater, for example, where a housing cemented into a foundation is originally intended to serve merely as a precipitation collector and where the insert 10 is added only subsequently to form an odor trap.

The aforedescribed and illustrated internal configuration of the upper part of conduit 11 directs the water flow without congestion or turbulence toward the exit. The progressively decreasing cross-section of the flow path, converging toward the outlet 32, creates a nozzle effect tending to sweep along any solids that might otherwise accumulate on the walls.

If space is no problem, the radius R of conduit 11 could be made considerably larger than illustrated in FIG. 4. On the other hand, even a ratio R:*r* smaller than 2:1 will allow the cross-sectional area 22 to equal or exceed that of the outlet 32, by virtue of the additional space provided between the peripheral conduit wall and the steep flanks 21 of tongue 16. If space limitations dictate the use of a particularly narrow conduit 11, a relative increase in the width of passage 22 can be achieved by moving the flanks 21 closer to each other, with corresponding shortening of the arc spanned by tongue bottom 16' and with partial obstruction of the outlet opening by an enlargement of lands 21' (FIG. 5) extending inwardly to these flanks from flange 13.

The cylindrical curvature of conduit 11 underneath midplane 19 (except along its flat face including the foot 14) is not essential and may be replaced in specific instances by different configurations.

I claim:

1. An odor trap for a drain, comprising:

an upwardly open housing having a substantially flat sidewall provided with an exit port for entering waste water;

a tubular insert in said housing adjacent said sidewall, said insert having a peripheral wall forming a bottom inlet beneath the level of said exit port and a circular lateral outlet registering with said exit port;

mounting means securing said insert to said sidewall; and an upwardly concave tongue in said insert spaced from said peripheral wall and extending inwardly from the lower periphery of said outlet, said tongue having a curved bottom hugging said outlet over substantially the lower third of its periphery and a pair of upstanding flanks on opposite sides of said curved bottom, said flanks rising to a level below a horizontal midplane of said outlet, said curved bottom rising to the same level and merging there gradually into said flanks along a generally U-shaped overflow edge whose bight is curved about a vertical axis disposed inwardly of said outlet and whose arms defined by said flanks are substantially perpendicular to said sidewall, said overflow edge being separated by a generally ring-segmental clearance from said peripheral wall, said clearance terminating at said sidewall and having a horizontal cross-sectional area at least equaling the cross-sectional area of the flow path of said outlet.

2. A trap as defined in claim 1 wherein said peripheral wall forms a generally cylindrical conduit flattened on the side of said outlet and curved about said vertical axis from said inlet to substantially said midplane with a radius exceeding the radius of said outlet, said peripheral wall merging above said midplane along a bend opposite said outlet into a part-cylindrical upper surface with substantially the same radius as said outlet and coaxial therewith.

3. A trap as defined in claim 2 wherein said part-cylindrical surface is bounded by two substantially horizontal edges overlying said midplane by a maximum distance of about half the radius of said outlet.

4. A trap as defined in claim 2 wherein said vertical axis is spaced from said outlet by a distance on the order of the radius of said outlet.

5. A trap as defined in claim 2 wherein, in a vertical plane of symmetry bisecting said outlet, the distance of said edge from said overflow outlet is approximately two-thirds the distance of said peripheral wall from said outlet.

6. A trap as defined in claim 2 wherein said conduit forms with said tongue a unitary body of plastic material.

7. A trap as defined in claim 2 wherein said insert is provided on said flattened side with a flange encircling said outlet and extending laterally beyond said conduit, said flange being provided with lateral holes spaced from said conduit, said mounting means comprising fasteners traversing said holes.

8. A trap as defined in claim 7 wherein said flange is provided with a circular groove confronting said sidewall, further comprising a packing ring seated in said groove.

9. A trap as defined in claim 2 wherein the radius of said conduit is approximately twice the radius of said outlet.

* * * * *